US005987760A

United States Patent [19]

Hsu

[11] Patent Number: 5,987,760

[45] Date of Patent: Nov. 23, 1999

[54] CIRCLE DRAWING TOOL

[75] Inventor: Walter W. Hsu, Yinlin Hsien, Taiwan

[73] Assignee: Walter's Co., Ltd., Yonlin Hsien, Taiwan

[21] Appl. No.: 08/993,992

[22] Filed: Dec. 18, 1997

[51] Int. Cl.[6] ..... B43L 9/00

[52] U.S. Cl. ..... 33/27.03; 33/562

[58] Field of Search ..... 33/27.03, 562, 33/555.1, 555.2

[56] References Cited

U.S. PATENT DOCUMENTS

| | | | |
|---|---|---|---|
| 3,795,053 | 3/1974 | Burke | 33/27.03 |
| 4,129,948 | 12/1978 | Hatter et al. | 33/27.03 |
| 4,589,210 | 5/1986 | Konrad | 33/27.03 |
| 4,899,449 | 2/1990 | Fouladian | 33/27.03 |
| 5,125,161 | 6/1992 | Guthrie | 33/27.03 |
| 5,384,964 | 1/1995 | McKay | 33/27.03 |
| 5,390,418 | 2/1995 | Buono et al. | 33/27.03 |
| 5,615,485 | 4/1997 | Stoneberg | 33/562 |

FOREIGN PATENT DOCUMENTS

| | | | |
|---|---|---|---|
| 2806617 | 8/1978 | Germany | 33/27.03 |
| 3134890 | 3/1983 | Germany | 33/27.03 |
| 564645 | 10/1944 | United Kingdom | 33/27.03 |

*Primary Examiner*—Diego Gutierrez
*Assistant Examiner*—Quyen Doan
*Attorney, Agent, or Firm*—Browdy and Neimark

[57] ABSTRACT

An improved circle drawing tool is equipped with a doughnut-shaped outer board, a circular slide track mounted onto the outer board and an inner circular board provided with rolling balls in a plurality of receiving cavities thereof and having such a diameter that it can be rotarily engaged with the slide track as well as the doughnut-shaped outer board in assembly. On the doughnut shaped outer board are disposed a plurality of round holes distributed one by one consecutively according to their diameters. The are 4 straight lines separated apart at 90 degrees in angle. There are a number of small pen insertion holes consecutively spaced by 4 mm on each line and each starting point of the four lines is 1 mm farther away from the center of the outer board. There are 10 radial lines equally divided on the inner circular board. On each radial line there are a plurality of consecutive pen insertion holes defined thereon with every two neighboring points 10 mm spaced apart. Each starting point of all the 10 lines is 1 mm farther away consecutively from the center of the circular board so as to make the pen insertion holes distributed within a certain range in 1 mm divisional level. An extension arm having a plurality of pen insertion holes can be connected to the rotary outer board so as to permit circles larger than the diameter of the outer board can be drawn.

3 Claims, 4 Drawing Sheets

CIRCLE DRAWING TOOL

BACKGROUND OF THE INVENTION

The present invention relates to an improved circle drawing tool which is equipped with a doughnut-shaped outer board, a circular slide track mounted onto the outer board and an inner circular board provided with rolling balls in a plurality of receiving cavities thereof and having such a diameter that it can be rotarily engaged with the slide track as well as the doughnut-shaped outer board in assembly. On the doughnut shaped outer board are disposed a plurality of round holes distributed closely one by one consecutively according to their diameters. There are 4 straight lines separated apart at 90 degrees in angle. There are a number of small pen insertion holes consecutively spaced by 4 mm on each line and each starting point of the four lines is 1 mm farther away from the center of the outer board one after the other. There are 10 radial lines equally divided on the inner circular board. On each radial line there are a plurality of consecutive pen insertion holes defined thereon with every two neighboring points 10 mm spaced apart. Each starting point of all the 10 lines is 1 mm farther away in a consecutive order from the center of the circular board so as to make the pen insertion holes distributed in a certain range in 1 mm division level. An extension arm having a plurality of pen insertion holes can be removably connected to the rotary outer board so as to permit circles larger than the diameter of the outer board to be drawn.

A compass is the most common tool used by people to draw circles, but there are different auxiliary instruments developed to facilitate the drawing of circles of various diameters, such as a standard circle board on which circles of various sizes are orderly distributed with their diameters marked beside each hole so as to permit people to make circle drawings with ease. However, such prior art circle boards are limited in the size of the circles to be drawn and the number of holes on each board is also limited. There are other various prior art auxiliary circle drawing boards which are complex in structure and relatively expensive to produce.

SUMMARY OF THE INVENTION

Therefore, the primary object of the present invention is to provide an improved circle drawing tool which is provided with a plurality of pen insertion holes disposed at positions consecutively spaced apart from the center of an inner circular board so as to permit circles of different diameters to be drawn.

Another object of the present invention is to provide an improved circle drawing tool provided with an extension arm which can be removably engaged with the outer board of the present invention and has a plurality of pen insertion holes to be consecutively distributed so as to permit larger circles to be drawn.

DETAILED DESCRIPTION OF THE PREFERRED EMBODIMENT

Figure 1:
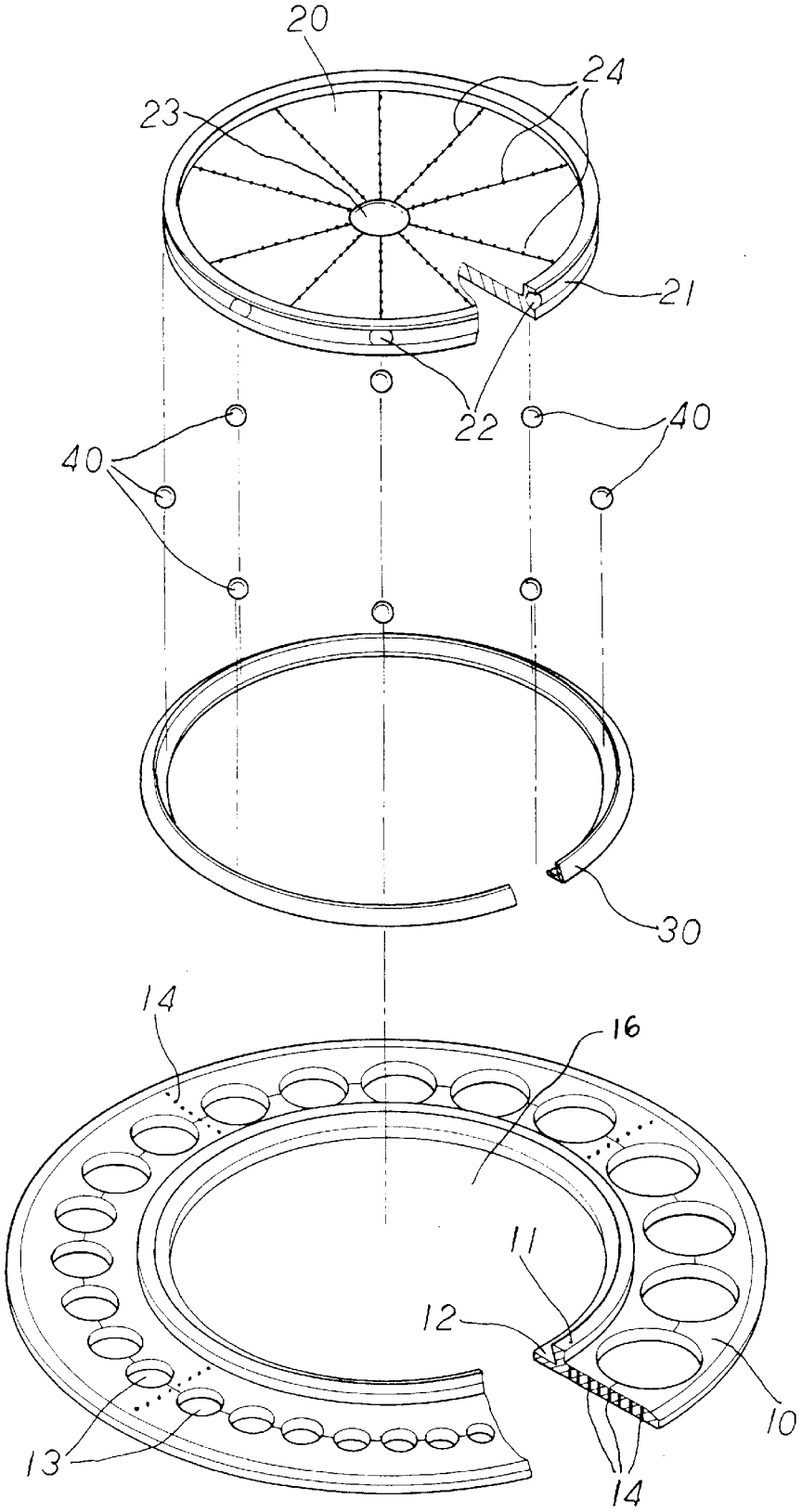
FIG. 1 is a perspective diagram showing the exploded components of the present invention.
Figure 4:
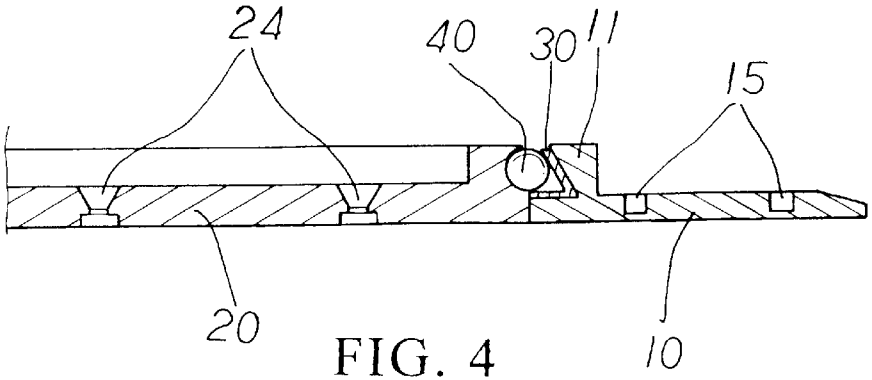
FIG. 4 is a sectional view of the present invention.

Referring to FIG. 1, the circle drawing tool of the present invention is comprised of a plastic doughnut-shaped outer board 10 having a large central hole 16, an inner circular board 20 received in the central hole 16 of the outer board 10. The central hole 16 is provided with a peripheral flange 11 with a V-shaped groove 12 formed at the root of the flange 11, as shown in FIG. 4. So, a circular slide track 30 of a V-shaped cross section can be housed in the V-shaped groove 12 and the inner circular board 20 slightly smaller of its diameter than the circular track 30.

There are a plurality of round holes 13 of different diameters disposed on the peripheral extension of the doughnut-shaped outer board 10, ranging consecutively from the smallest one to the largest one of them. Four lines of pen insertion holes 14 separated apart by 4 mm each other are disposed at four positions 90 degrees apart. From the first line to the fourth line, the position of each starting point of each line is located 1 mm farther away from the center of the outer board in a consecutive order.

There are 10 radial lines equally divided on the inner circular board 20. On each radial line there are a plurality of consecutive pen insertion holes 24 defined thereon with every two neighboring points 10 mm spaced apart. Each starting point of all the 10 lines is 1 mm farther away consecutively from the center of the circular inner board 20 so as to make the pen insertion holes 24 distributed within a certain range in 1 mm divisional level. For instance, the starting point on the first line starts from a position defined as A+1 mm from the center of the inner board, and the second line starts from A+1 mm, the third line starts from A+2 mm, and the fourth line starts from A+3 mm from the center, and so on so forth. In such a manner, there are a plurality of points covering A+1 mm, A+2 mm, A+3 mm . . . and etc.

Figure 2:
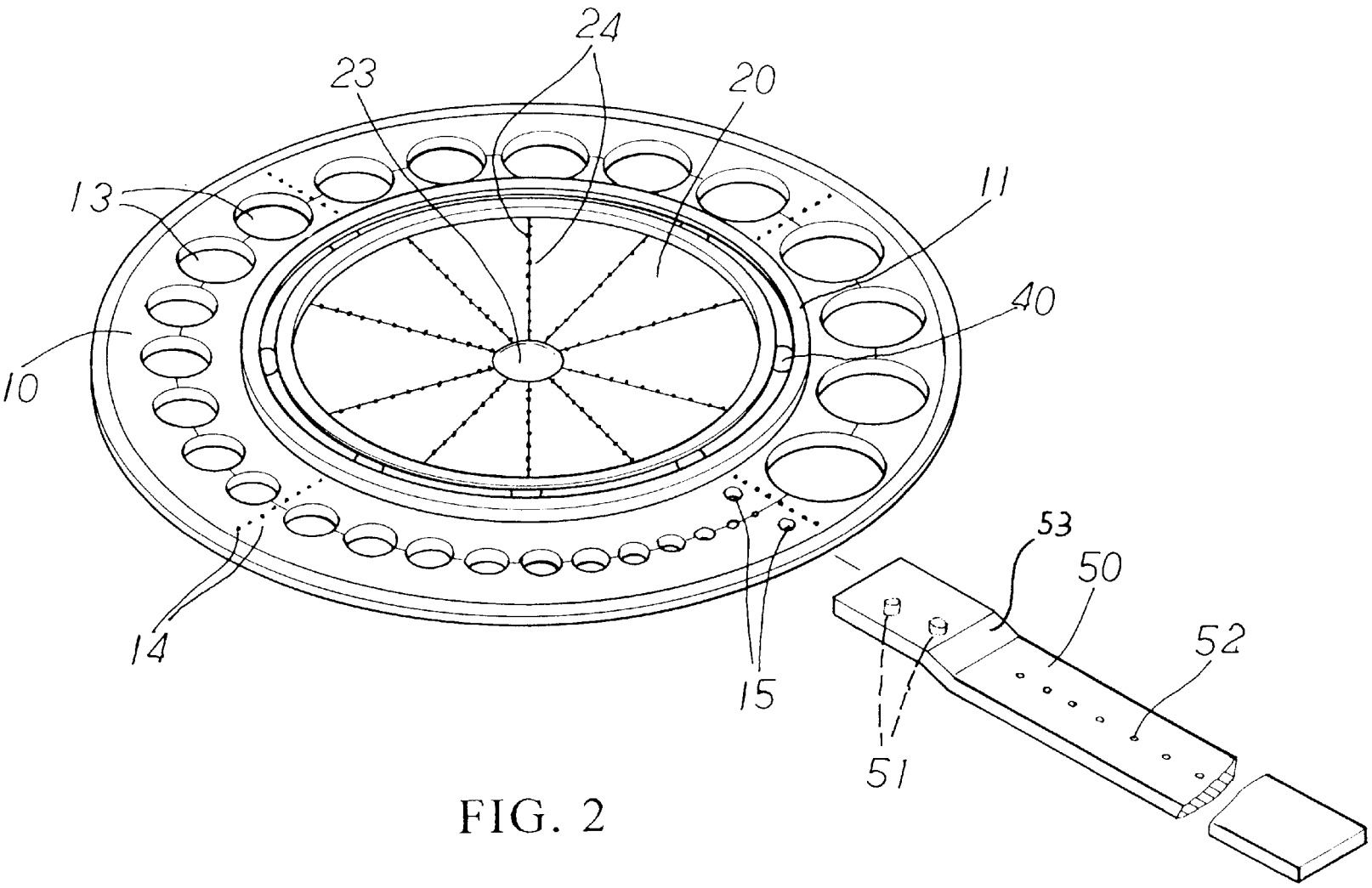
FIG. 2 is a perspective diagram showing the assembly of the present invention.

On the peripheral wall of the inner circular board 20 is disposed a recessed track 21 in which a plurality of receiving cavities 22 for housing the rolling balls 40 are spaced at a proper distance. The assembly of the present invention is illustrated in FIG. 2.

Figure 3:
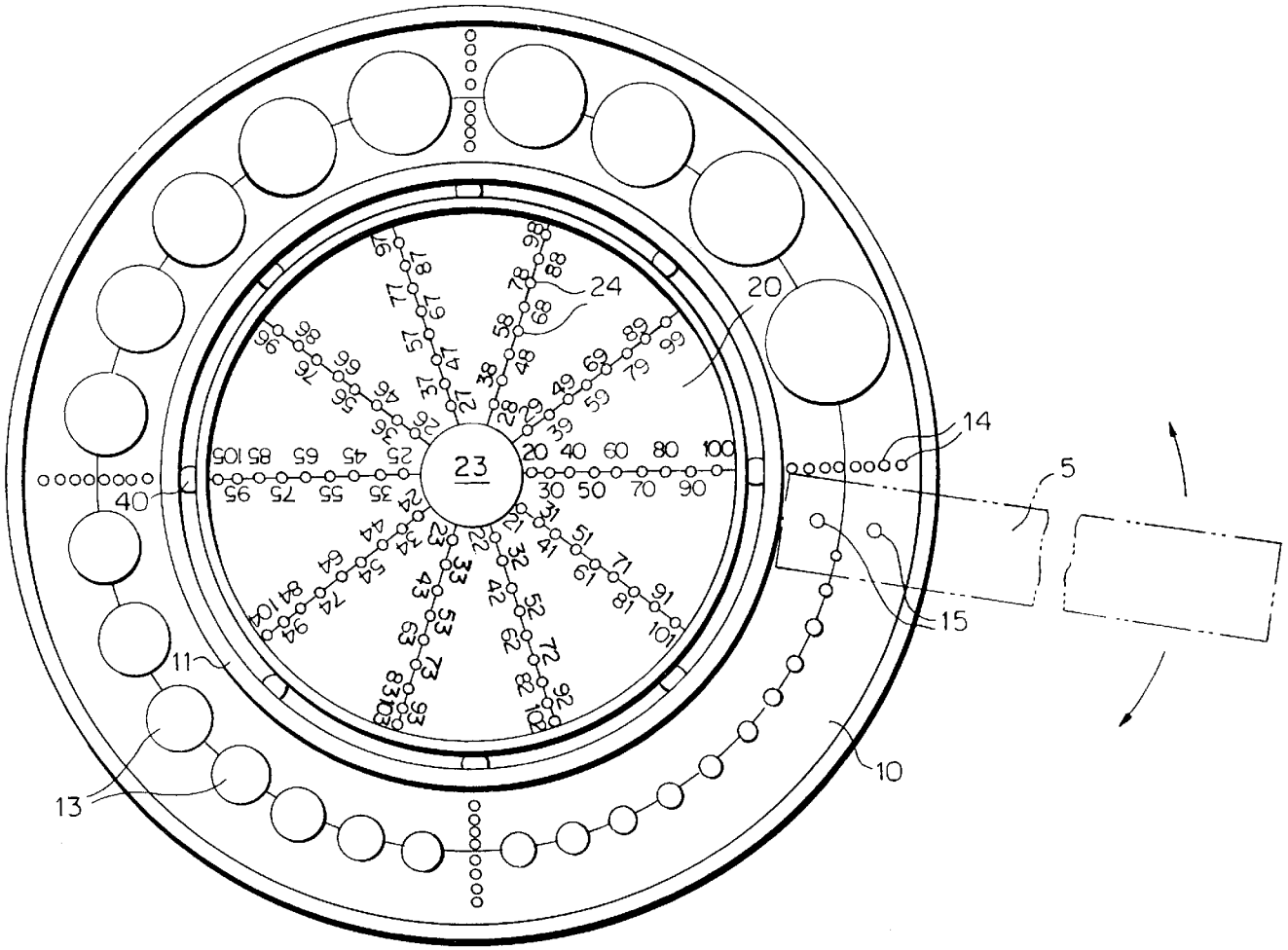
FIG. 3 is a plane view showing the assembly of the present invention.

Referring to FIG. 3, the inner circular board 20 is provided with a protruded round portion 23 serving as a magnifying means and from the periphery of the round portion 23 the ten radially extended lines equally spaced at an angle.

In other words, each point on the ten lines is 10 mm separated from a neighboring point and the starting points of the ten lines are placed 1 mm farther away from the center of the protruded round portion 23 consecutively, for instance, the starting point on the first line is 20 mm from the center and the starting point on the second line is 21 mm, and is 22 mm for the third line and so on so forth. In other words, the pen insertion points 24 on the first line range from 20 mm–100 mm, from 21–101 mm on the second line and from 22 mm–102 mm on the third line, and so on so forth. Therefore, there is a pen insertion hole 24 located on one of the ten lines at every 1 mm away from the center of the inner circular board 20.

The rolling balls 40 disposed in the receiving cavities 22 of the inner circular board 20 and the V-shaped circular slide track 30 housed in the V-shaped groove 12 can support the outer ring board 10 and the inner circular board 20 to be relatively rotated with respect to each other when a pencil is placed in any one of the pen insertion holes 14 or 24 to draw a circle.

In practical operation, the circle drawing tool is placed on top of a paper and a pencil is selectively inserted into any one of the pen insertion holes 14 and 24 according to the size of the circle needed and then the pencil is moved in a circle, resulting in the rotation of the inner circular board 20 or the outer board 10 with respect to each other so that circles of various diameters can be drawn selectively.

Figure 5:
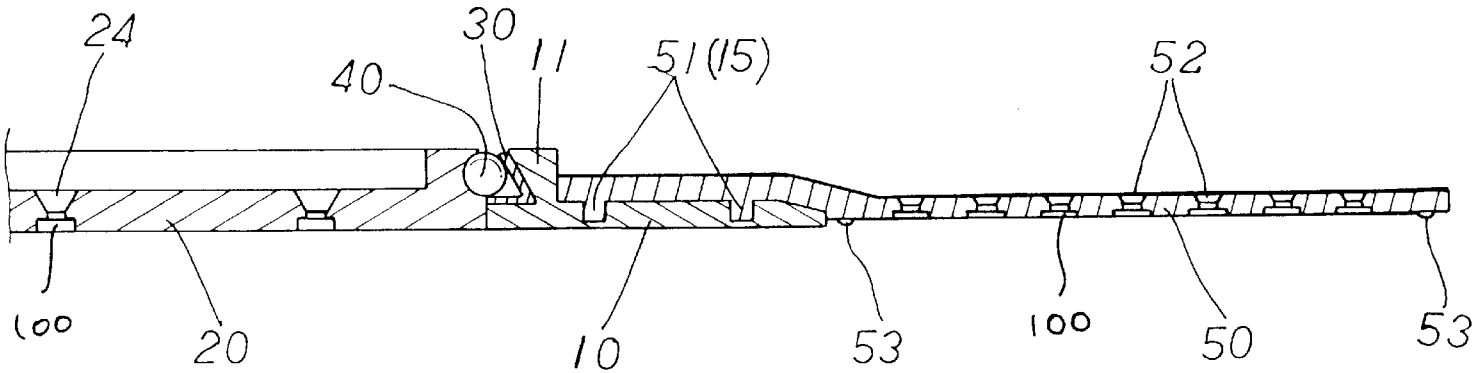
FIG. 5 is a sectional view of the assembly of the present invention wherein the tool is extendedly assembled to draw circles having larger diameters.

Referring farther to FIGS. 2, 3, an extension arm 5 having two protrusion points 51 disposed at one end is provided with a plurality of pen insertion holes 52 consecutively disposed thereon. In correspondence to the two protrusion points 51 there are two engagement holes 15 disposed on the outer board 10 so as to permit the extension arm to be attached to the outer board 10, as shown in FIG. 5. To make the connection of the extension arm 50 and the outer board 10 smooth, the frontmost end of the extension arm 50 is higher than the rest of the arm with a slant portion 53 defined therebetween so that when the frontmost end of the extension arm 50 is mounted onto the outer board 10, the rest of the arm 50 is kept close contact with the horizontal face, as shown in FIG. 5.

To avoid excessive ink to get the paper stained in the process of drawing, each pen insertion hole 14, 24 or 52 is provided with a widened recess 100 so that ink will not easily spread on the paper along with the rotation of the extension arm 50, the outer board 10 and the inner circular board 20.

I claim:

1. An improved circle drawing tool comprising:

a doughnut-shaped outer board;

a circular slide track; and an inner circular board;

said doughnut-shaped outer board having a large central hole with said inner circular board being rotatably received therein;

said central hole being provided with a peripheral flange with a V-shaped groove formed at the root of said flange so as to permit said circular slide track having a V-shaped cross section to be housed therein;

said inner circular board having a slightly smaller diameter than said circular slide track so that said inner circular board is rotatably engaged with said doughnutshaped outer board;

a plurality of round holes of different diameters disposed on the peripheral area of said doughnut shaped outer board, ranging consecutively from a smallest hole to a largest hole;

four radial lines of pen insertion holes separated from each other; said four radial lines being disposed at four positions at 90 degrees apart on said outer board;

a position of each starting point of each line being 1 mm farther away from the center of said outer board consecutively;

10 radial lines equally spaced being placed on said inner circular board, each line having plurality of consecutive pen insertion holes defined thereon with every two neighboring points being 10 mm spaced apart;

each starting point of all said 10 radial lines being 1 mm farther away consecutively from the center of said circular board;

on the peripheral wall of said inner circular board being disposed a recessed track in which a plurality of receiving cavities are located for housing rolling balls, said cavities being spaced at a proper distance from each other so that said rolling balls are able to be smoothly engaged with said V-shaped slide track, permitting said inner board and said outer board to be relatively rotated with respect to each other when a pen is placed in one of said pen insertion holes for drawing a circle.

2. The improved circle drawing tool as claimed in claim 1 wherein said doughnut shaped outer board is provided with two engagement holes so as to permit an extension arm having a line of pen insertion holes consecutively disposed thereon and a pair of protrusion points in correspondence to said engagement holes to be removably attached to said outer board; a frontmost end of said extension arm being slightly higher than the rest thereof and a slanted portion is disposed therebetween so as to keep said extension arm in close contact with a horizontal plane in operation.

3. The improved circle drawing tool as claimed in claim 1 wherein the inner circular board is provided with a protruded round portion serving as a magnifying means and each of said pen insertion holes is provided with a widened recess for preventing ink from staining a paper in the process of drawing circles.

* * * * *